US007815754B2

(12) United States Patent
Ushigami et al.

(10) Patent No.: US 7,815,754 B2
(45) Date of Patent: Oct. 19, 2010

(54) GRAIN-ORIENTED ELECTRICAL STEEL SHEET SUPERIOR IN CORE LOSS CHARACTERISTIC

(75) Inventors: Yoshiyuki Ushigami, Tokyo (JP); Norikazu Fujii, Tokyo (JP); Kenichi Murakami, Tokyo (JP); Nobusato Morishige, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/227,382

(22) PCT Filed: May 7, 2007

(86) PCT No.: PCT/JP2007/059812

§ 371 (c)(1),
(2), (4) Date: Nov. 13, 2008

(87) PCT Pub. No.: WO2007/135877

PCT Pub. Date: Nov. 29, 2007

(65) Prior Publication Data

US 2009/0173413 A1 Jul. 9, 2009

(30) Foreign Application Priority Data

May 24, 2006 (JP) ..... 2006-144058

(51) Int. Cl.
*H01F 1/147* (2006.01)

(52) U.S. Cl. ..... 148/308; 148/320

(58) Field of Classification Search ..... None
See application file for complete search history.

(56) References Cited

U.S. PATENT DOCUMENTS 3,287,183 A 11/1966 Taguchi et al.
5,800,633 A * 9/1998 Inokuti ..... 148/111

FOREIGN PATENT DOCUMENTS

| | | |
|---|---|---|
| JP | 53-129116 | 11/1978 |
| JP | 57-009418 | 2/1982 |
| JP | 59-177349 | 10/1984 |
| JP | 62-040315 | 2/1987 |
| JP | 62-045285 | 9/1987 |
| JP | 2002-60842 | 2/2002 |

OTHER PUBLICATIONS

International Search Report dated Jul. 31, 2007 issued in corresponding PCT Application No. PCT/JP2007/059812.

(Continued)

*Primary Examiner*—John P Sheehan
(74) *Attorney, Agent, or Firm*—Kenyon & Kenyon LLP

(57) ABSTRACT

Grain-oriented electrical steel sheet superior in core loss characteristic containing Si: 0.8 to 7 mass % and having a secondary recrystallized texture with a {110}<001> orientation as the main orientation, characterized in that average deviation angles α, β, and γ from the {110}<001> ideal orientation of the secondary recrystallized texture satisfy $(\alpha^2+\beta^2)^{1/2} \leqq \gamma$, where α: average deviation angle from {110}<001> ideal orientation around rolling surface normal direction (ND) of secondary recrystallized texture, β: average deviation angle from {110}<001> ideal orientation around traverse direction (TD) of secondary recrystallized texture, and γ: average deviation angle from {110}<001> ideal orientation around rolling direction (RD) of secondary recrystallized texture.

6 Claims, 5 Drawing Sheets

OTHER PUBLICATIONS

T. Sato, et al., "*Approaches to the Lowest Core Loss in Grain-Oriented 3% Silicon Steel with High Permeability,*" IEEE Transactions on Magnets, vol. MAG-14, No. 5, pp. 350-352 (1978).

T. Nozawa, et al., "*Relationship Between Total Losses under Tensile Stress in 3 Percent Si-Fe Single Crystals and Their Orientations Near* (*110*) [*001*]," IEEE Transactions on Magnetics, vol. MAG-14, No. 4, pp. 252-257 (1978).

Y. Ushigami, et al., "*Effect of Primary Recrystallization Texture on Goss Secondary Recrystallization Texture in Fe-3%Si Alloy,*" Proceedings of 12$^{th}$ International Conference on Textures of Materials, vol. 2, pp. 981-990 (1998).

* cited by examiner (a)

(b)

GRAIN-ORIENTED ELECTRICAL STEEL SHEET SUPERIOR IN CORE LOSS CHARACTERISTIC

TECHNICAL FIELD

The present invention relates to grain-oriented electrical steel sheet superior in core loss characteristic used as a soft magnetic material as a core of a transformer, electrical equipment, etc.

BACKGROUND ART

Grain-oriented electrical steel sheet is steel sheet usually containing Si up to 7% and having a secondary recrystallized texture of secondary recrystallized grains aligned in the {110}<001> orientation (Goss orientation). The magnetic properties of grain-oriented electrical steel sheet basically are greatly affected by the {110}<001> alignment of the secondary recrystallized grains. For this reason, up to now, there has been much R&D conducted into methods of production for improving the alignment of secondary recrystallized grains (for example, see U.S. Pat. No. 3,287,183 and Japanese Patent Publication (B2) No. 62-45285).

However, as explained in "IEEE Transactions on Magnetics" MAG-14 (1978), pp. 350-352, it is learned that if the orientation alignment becomes too high, conversely the core loss characteristic deteriorates. Therefore, for example, the deviation angle (α) around the rolling surface normal direction (ND) from the {110}<001> ideal orientation, the deviation angle (β) around the traverse direction (TD), and the deviation angle (γ) around the rolling direction (RD) are being used to further refine the orientation alignment and study the relationship with the core loss characteristic.

Here, FIG. 1 shows the definitions of the deviation angles on a {100} pole figure (see "IEEE Transactions on Magnetics" MAG-14 (1978), pp. 252-257). Further, FIG. 2 schematically shows the ideal {110}<001> oriented grains. Further, FIG. 3(*a*) schematically shows the secondary recrystallization orientation and deviation angles (α and β), while FIG. 3(*b*) schematically shows the secondary recrystallization orientation and the deviation angle (γ).

Further, in the above studies, as measures for improving the core loss characteristic, several grain-oriented electrical steel sheets defining the alignment of secondary recrystallized grains based on the above deviation angle indicators have been proposed.

For example, Japanese Patent Publication (B2) No. 57-9418 discloses grain-oriented electrical steel sheet superior in magnetic properties having a crystal structure comprised of {h,k,0} planes with <001> axes of the individual crystal grains matching with the rolling direction of the steel sheet and with indexes of the crystal planes parallel to the steel sheet surface dispersed rotated around the rolling direction.

However, the <001> axes of crystal grains of actual products, as shown in FIG. 3(*a*), are also dispersed around the ND and/or TD, so making the <001> axes of the individual crystal grains match in the rolling direction of the steel sheet is difficult.

Further, Japanese Patent Publication (A) No. 59-177349 and "IEEE Transactions on Magnetics" MAG-14 (1978), pp. 252-257 disclose low core loss grain-oriented electrical steel sheet comprised of a crystal structure with [001] axes of the secondary recrystallized grains inclined with respect to the rolling surface by 4° or less, preferably 2° or so.

However, while this grain-oriented electrical steel sheet has the <001> axes of the individual crystal grains inclined around the traverse direction (TD), the deviation angle (α) around the rolling surface normal direction (ND) and the deviation angle (γ) around the rolling direction (RD) are not prescribed.

In this way, several discoveries have been obtained regarding the relationship between the deviation angles from the {110}<001> ideal orientation and the core loss characteristic for a simple system such as described in Japanese Patent Publication (B2) No. 57-9418 or Japanese Patent Publication (A) No. 59-177349, but the relationship between the actual orientation distribution about {110}<001> and the core loss characteristic has not been grasped overall.

DISCLOSURE OF THE INVENTION

The present invention has as its object, based on the current situation where grain-oriented electrical steel sheet is being further required to be improved in core loss characteristic, to elucidate the state of the relationship between the state of dispersion around the {110}<001> orientation of the actual secondary recrystallized texture and the core loss characteristic and to provide grain-oriented electrical steel sheet improved in core loss characteristic over the conventional limit.

The inventors investigated in depth the reasons where there are limits to improvement of the core loss characteristic by just making the orientation of the {110}<001> secondary recrystallized texture close to the {110}<001> ideal orientation (see "IEEE Transactions on Magnetics" MAG-14 (1978), pp. 350-352 and Japanese Patent Publication (A) No. 59-177349). As a result, the inventors learned that to improve the core loss characteristic over the past, (i) The degree of deviation of the secondary recrystallized texture from the {110}<001> ideal orientation must be evaluated not only by the deviation angle α around the rolling surface normal direction (ND) and deviation angle β around the traverse direction (TD), but also the deviation angle γ around the rolling direction (RD) and, further, (ii) The deviation angle γ has to be adjusted to at least a predetermined angle determined by the deviation angles α and β.

The present invention was made based on the above discoveries and has as its gist the following:

(1) Grain-oriented electrical steel sheet superior in core loss characteristic containing Si: 0.8 to 7 mass % and having a secondary recrystallized texture with a {110}<001> orientation as the main orientation, said grain-oriented electrical steel sheet characterized in that average deviation angles α, β, and γ from the {110}<001> ideal orientation of the secondary recrystallized texture satisfy the following formula (1):

$$(\alpha^2+\beta^2)^{1/2} \leqq \gamma \quad (1)$$

where,

α: average deviation angle from {110}<001> ideal orientation around rolling surface normal direction (ND) of secondary recrystallized texture β: average deviation angle from {110}<001> ideal orientation around traverse direction (TD) of secondary recrystallized texture γ: average deviation angle from {110}<001> ideal orientation around rolling direction (RD) of secondary recrystallized texture (2) Grain-oriented electrical steel sheet superior in core loss characteristic containing Si: 0.8 to 7 mass % and having a secondary recrystallized texture with a {110}<001> orientation as the main orientation, said grain-oriented electrical steel sheet characterized in that average deviation angles α, β, and γ from the {110}<001> ideal orientation of the secondary recrystallized texture satisfy the following formulas (1) and (2):

$$(\alpha^2+\beta^2)^{1/2} \leqq \gamma \quad (1)$$

$$(\alpha^2+\beta^2)^{1/2} \leqq 4.4° \quad (2)$$

where,

α: average deviation angle from {110}<001> ideal orientation around rolling surface normal direction (ND) of secondary recrystallized texture β: average deviation angle from {110}<001> ideal orientation around traverse direction (TD) of secondary recrystallized texture γ: average deviation angle from {110}<001> ideal orientation around rolling direction (RD) of secondary recrystallized texture (3) Grain-oriented electrical steel sheet superior in core loss characteristic containing Si: 0.8 to 7 mass % and having a secondary recrystallized texture with a {110}<001> orientation as the main orientation, said grain-oriented electrical steel sheet characterized in that average deviation angles α, β, and γ from the {110}<001> ideal orientation of the secondary recrystallized texture satisfy the following formulas (1) and (3):

$$(\alpha^2+\beta^2)^{1/2} \leqq \gamma \quad (1)$$

$$(\alpha^2+\beta^2)^{1/2} \leqq 3.6° \quad (3)$$

where,

α: average deviation angle from {110}<001> ideal orientation around rolling surface normal direction (ND) of secondary recrystallized texture β: average deviation angle from {110}<001> ideal orientation around traverse direction (TD) of secondary recrystallized texture γ: average deviation angle from {110}<001> ideal orientation around rolling direction (RD) of secondary recrystallized texture (4) Grain-oriented electrical steel sheet superior in core loss characteristic as set forth in any one of (1) to (3) characterized in that an area of crystal grains satisfying the formula (1) is 40% or more.

(5) Grain-oriented electrical steel sheet superior in core loss characteristic as set forth in any one of (1) to (4) characterized in that said grain-oriented electrical steel sheet contains, by mass %, in addition to Si: 0.8 to 7%, at least one of Mn: 1% or less, Cr: 0.3% or less, Cu: 0.4% or less, P: 0.5% or less, Ni: 1% or less, Mo: 0.1% or less, Sn: 0.3% or less, and Sb: 0.3% or less.

According to the present invention, it is possible to provide grain-oriented electrical steel sheet having a superior core loss characteristic exceeding the conventional limit.

BEST MODE FOR CARRYING OUT THE INVENTION

Figure 1:
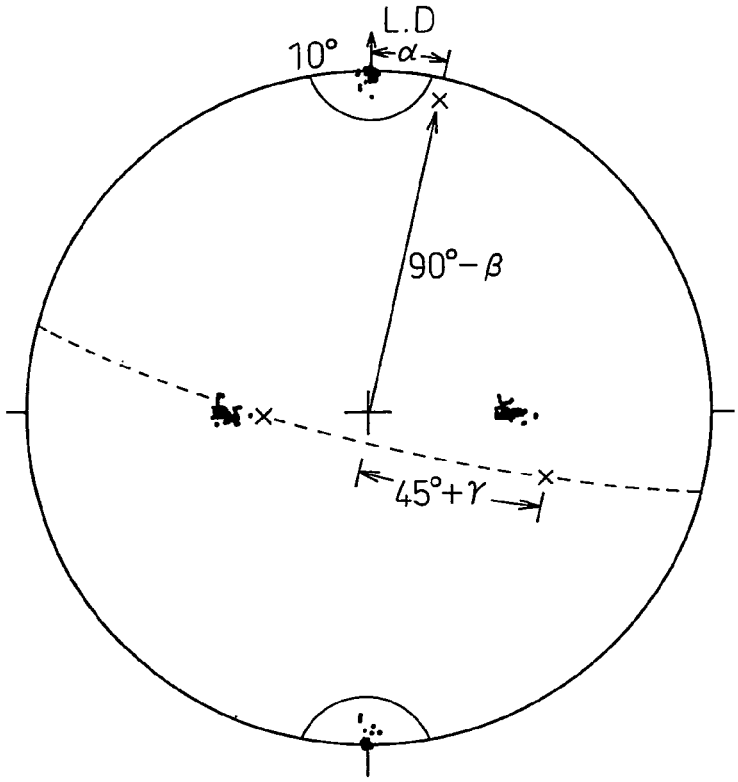
FIG. 1 is a view showing the definitions of the deviation angles α, β, and γ from the {110}<001> ideal orientation in the method for evaluation of the alignment of the secondary recrystallized texture.
Figure 2:
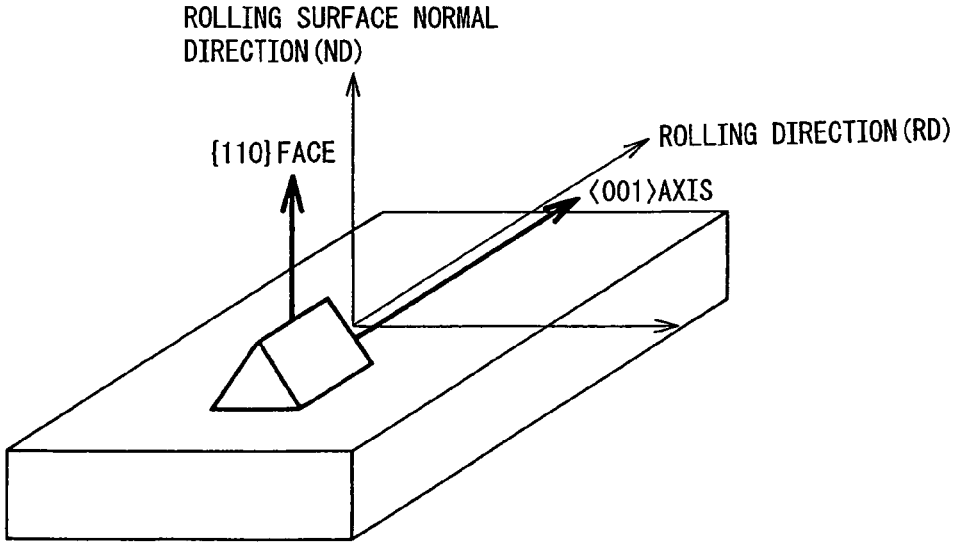
FIG. 2 is a view schematically showing the {110}<001> orientation.
Figure 3:
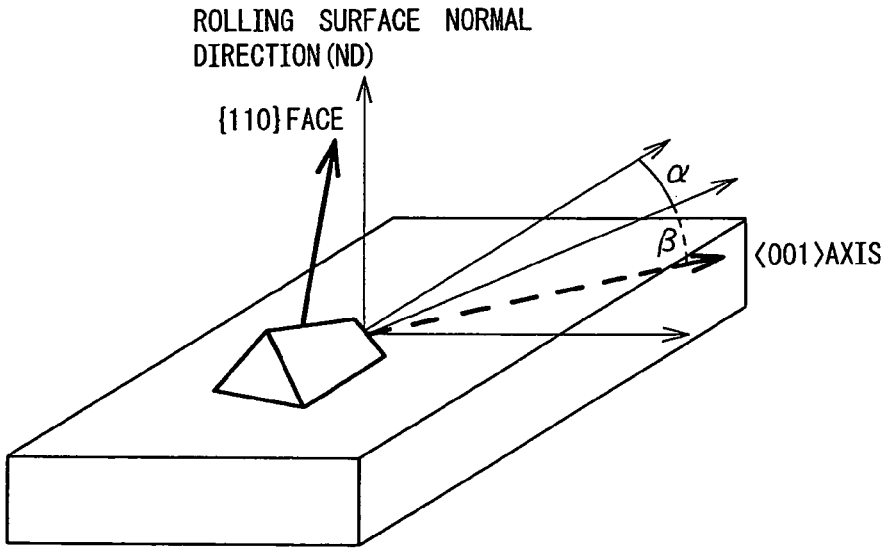
FIG. 3 is a view schematically showing the method of evaluation of alignment of the secondary recrystallized texture (deviation angles α, β, and γ from {110}<001> orientation). (a) shows the deviation angles α and β, while (b) shows the deviation angle γ.
Figure 3:
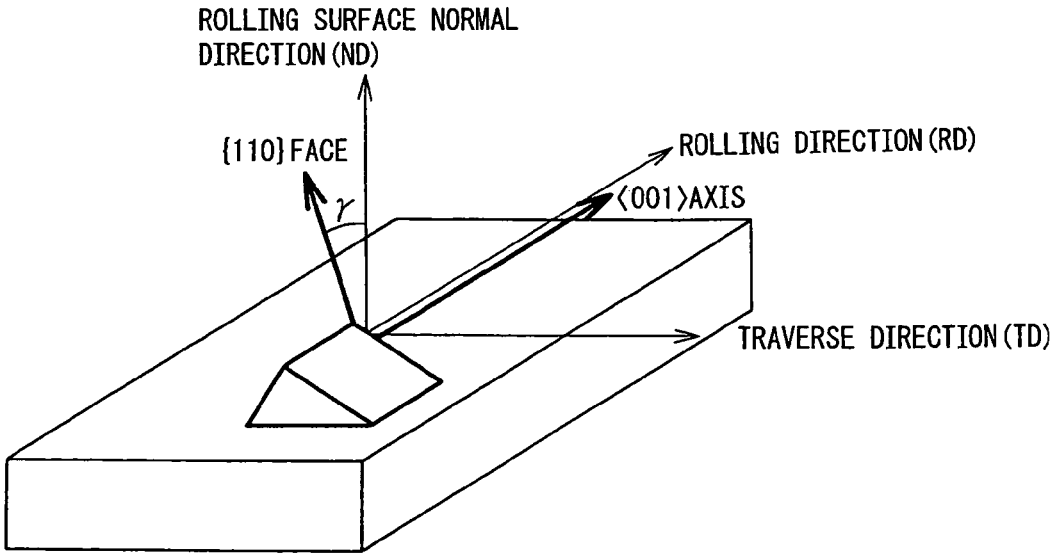

The present invention will be explained in detail based on the drawings. As shown in FIG. 3(*a*), in the past, mainly the alignment of the {110}<001> secondary recrystallized texture was evaluated by the deviation angles between the axes of easy magnetization, that is, the <001> axes of the crystal, and the rolling direction of the steel sheet (deviation angle α and deviation angle β). However, as explained above, with just this conventional evaluation means, strictly speaking it is not possible to evaluate the actual core loss characteristic of a product.

The {110}<001> orientation in fact, as shown in FIG. 3(*b*), rotates around the rolling direction (RD). In addition to the deviation angles α and β, the {110} plane is inclined from the ideal {110} plane by the deviation angle γ.

The inventors, as explained above, came up with the idea that to reduce the core loss more, the alignment of the secondary recrystallized texture in the {110}<001> orientation should be evaluated along with the deviation angles between the axis of easy magnetization, that is, the <001> axis of the crystal, and the rolling direction of the steel sheet (deviation angle α and deviation angle β) by including also the "deviation angle γ" and investigated in depth the relationship between the magnetic properties and the alignment in the {110}<001> orientation (deviation angle α, deviation angle β, and deviation angle γ).

For this investigation, it is necessary to produce and evaluate steel sheets changed in {110}<001> orientation alignments (deviation angle α, deviation angle β, and deviation angle γ) in various ways.

The inventors, as shown in "Proceedings of 12th International Conference on Textures of Materials" (1998), pp. 981-990, discovered that by controlling the texture after primary recrystallization, it is possible to control not only the alignment of the axes of easy magnetization <001> to the rolling direction, but the deviation angle (α) around the rolling surface normal direction (ND), the deviation angle (β) around the traverse direction (TD), and the deviation angle (γ) around the rolling direction (RD).

Therefore, by applying this technique for control of the primary recrystallized texture, products having various secondary recrystallization orientation distributions (deviation angle α, deviation angle β, and deviation angle γ) were produced and investigated for the relationship between the crystal orientation and the core loss characteristic.

0.23 mm thick grain-oriented electrical steel sheet (sample A) prepared by the method of production described in U.S. Pat. No. 3,287,183 was harvested for 60×300 mm measurement samples which were measured for core loss and magnetic flux density. Further, each measurement sample was measured at 5 mm intervals for the orientation of the crystal grains at 171 points. The average deviation angles α, β, and γ were calculated.

Further, 0.23 mm sheet thick grain-oriented electrical steel sheet (sample B) prepared by the method of production described in Japanese Patent Publication (A) No. 2002-60842 was similarly harvested for similarly measurement samples and was similarly measured.

Figure 4:
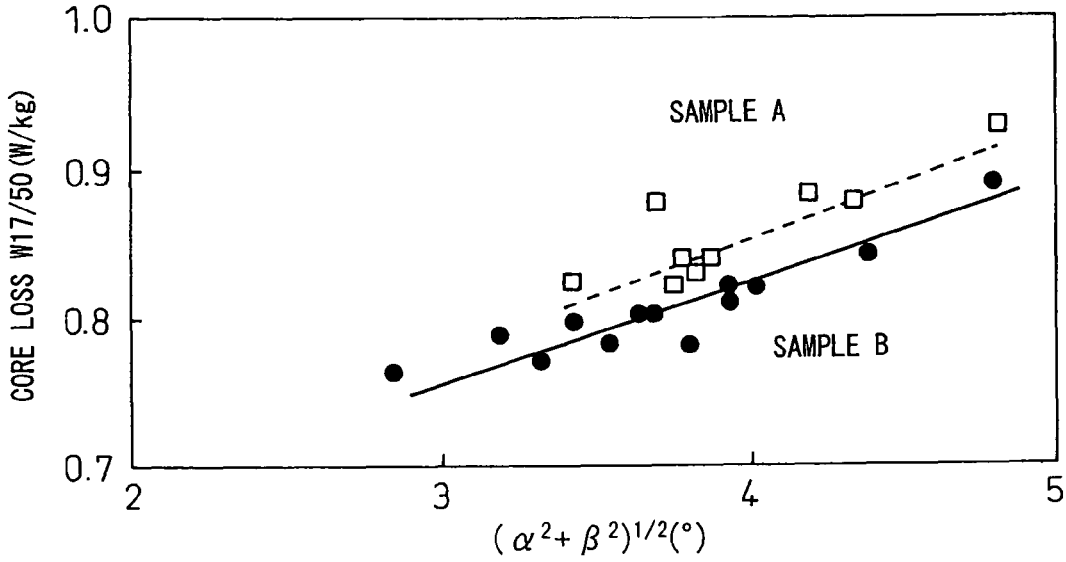
FIG. 4 is a view showing the relationship between the core loss W17/50 (W/kg) and the $(\alpha^2+\beta^2)^{1/2}$ (°).
Figure 5:
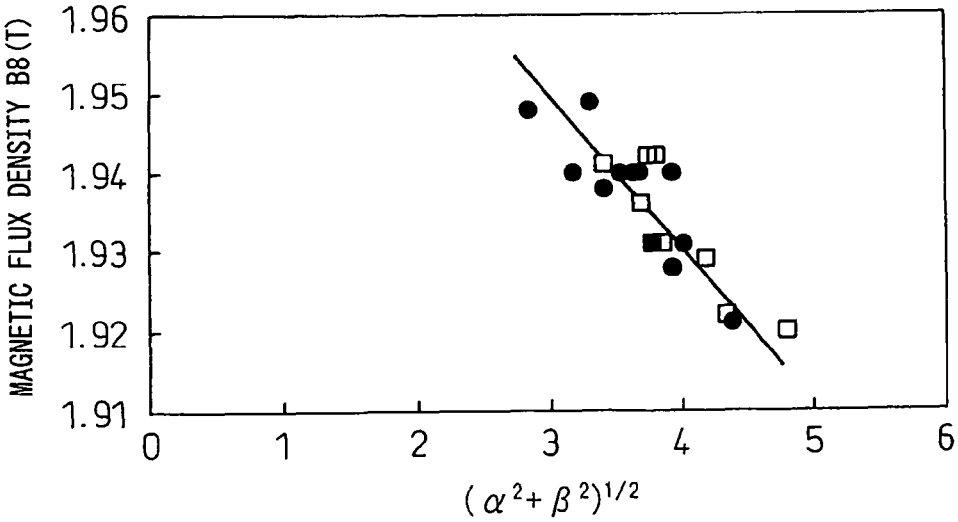
FIG. 5 is a view showing the relationship between the magnetic flux density $B_8$ (T) and $(\alpha^2+\beta^2)^{1/2}$ (°).

FIG. 4 shows the relationship between the core loss W17/50 (W/kg) and the $(\alpha^2+\beta^2)^{1/2}$ (°), while FIG. 5 shows the relationship between the magnetic flux density $B_8$ (T) and $(\alpha^2+\beta^2)^{1/2}$ (°). For the magnetic flux density $B_8$ (T), to clarify the relationship with the secondary recrystallized texture of the steel sheet, the nonmagnetic materials (glass film and coating) on the product surface were removed before measurement. Note that in the figure, the white squares indicate the magnetic properties of the sample A, while the block dots shown the magnetic properties of the sample B.

In the present invention, as one indicator for evaluation of the alignment of the {110}<001> secondary recrystallized texture, the deviation indicator $(\alpha^2+\beta^2)^{1/2}$ (°) is employed. This indicator expresses the deviation angle between the axis of easy magnetization, that is, the <001> axis of the crystal, and the rolling direction of the steel sheet. In the present invention, as an indicator for evaluation of the alignment of the {110}<001> secondary recrystallized texture, not just the deviation angle α and the deviation angle β, but also the above axial deviation indicator is employed.

As shown in FIG. 4, the core loss W17/50 is linearly improved along with a reduction in the $(\alpha^2+\beta^2)^{1/2}$ (°). Further, as shown in FIG. 5, the magnetic flux density $B_8$ also is linearly improved along with a reduction in the $(\alpha^2+\beta^2)^{1/2}$ (°).

In general, if the deviation angles α and β become smaller and the alignment of the {110}<001> secondary recrystallized texture is improved, the core loss is reduced and the magnetic flux density is increased, but the point which should be noted in FIG. 4 and FIG. 5 is that the $(\alpha^2+\beta^2)^{1/2}$ (°) and the core loss characteristic and magnetic flux density exhibit a linear correlative relationship.

This shows the suitability and significance, when evaluating the alignment of the {110}<001> secondary recrystallized texture using the deviation angles α and β, of not simply using the deviation angles α and β, but using the deviation indicator $(\alpha^2+\beta^2)^{1/2}$ (°) devised by the inventors.

This point is one of the discoveries (discovery Y) found by the inventors and is a discovery forming the basis of the present invention.

Based on this discovery Y, the inventors intensively investigated the relationship between the alignment of {110}<001> secondary recrystallized texture including the deviation angle γ (°) and the magnetic properties.

Figure 6:
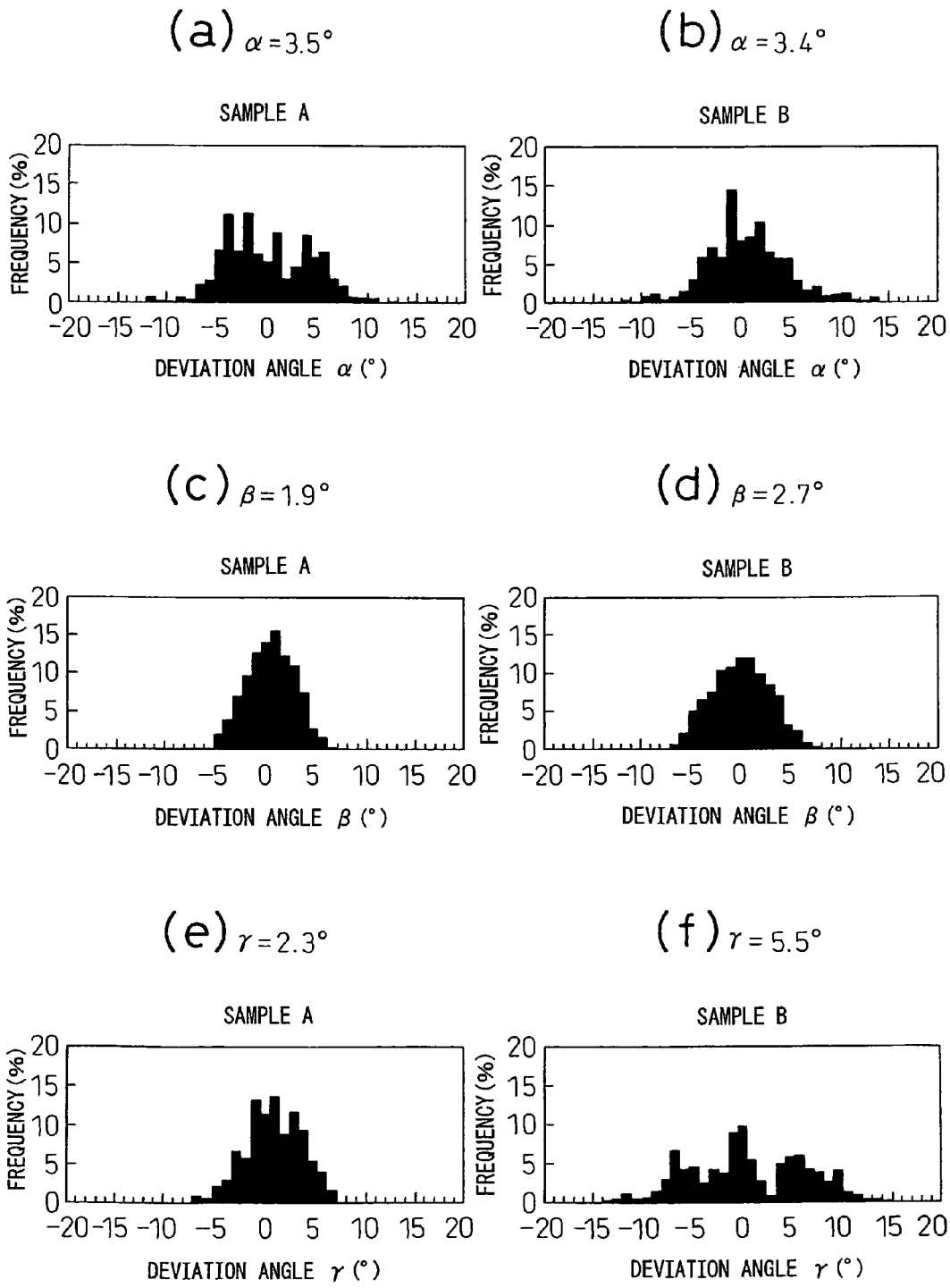
FIG. 6 is a view showing the ratio of secondary recrystallized grains with respect to the deviation angles α, β, and γ from the {110}<001> ideal orientation of the secondary recrystallized texture. (a), (c), and (e) show the distributions of the deviation angles α, β, and γ in the grain-oriented electrical steel sheet prepared by the method of production based on U.S. Pat. No. 3,287,183. (b), (d), and (f) show the distributions of the deviation angles α, β, and γ in the grain-oriented electrical steel sheet prepared by the method of production based on Japanese Patent Publication (A) No. 2002-60842.

Here, FIGS. 6(*a*), (*c*), and (*e*) show the distributions of the deviation angle α, β, and γ in the sample A (white squares in FIGS. 4 and 5), while FIG. 6(*b*), (*d*), and (*f*) show the distributions of the deviation angles α, β, and γ of the sample B (black dots in FIGS. 4 and 5).

From FIG. 6, it will be understood that in the sample B superior in core loss characteristic, the deviation angle γ spreads. This means, in securing a good core loss characteristic, (i) the deviation angles α and β are preferably as small as possible, while (ii) the deviation angle γ preferably is spread to a certain extent.

Figure 7:
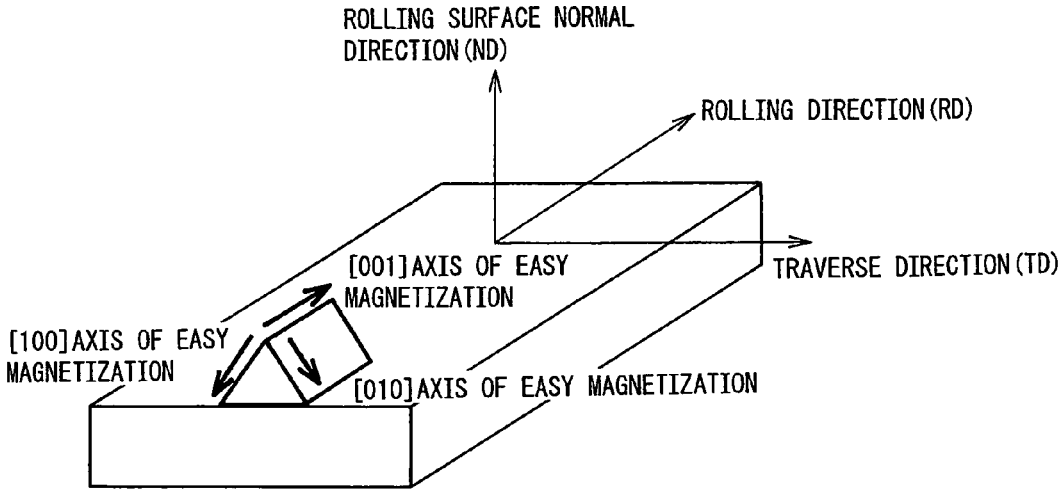
FIG. 7 is a view schematically showing the three axes of easy magnetization in grain-oriented electrical steel sheet.

The reason why the deviation angle γ is preferably spread to a certain extent to secure a good core loss characteristic is believed to be as follows:

As shown in FIG. 7, grain-oriented electrical steel sheet has three axes of easy magnetization <001>. One axis of easy magnetization [001] is parallel to the rolling direction, while the other two axes of easy magnetization [100] and [010] are in directions forming angles of 45° with the inner surface in the traverse direction of the steel sheet.

In general, from the viewpoint of minimizing the overall energy, among these three axes of easy magnetization, the axis of easy magnetization [001] parallel to the rolling direction is easily excitable. As a result, stripe shaped 180° domains are formed.

To reduce the core loss, it is necessary to narrow the width of the 180° domains. To narrow the width of the 180° domains, it is effective to excite the axis of easy magnetization in a direction forming an angle of 45° with the inner surface in the traverse direction of the steel sheet explained later among the above three axes of easy magnetization so as to form closure domains in the 180° domains. The closure domains are believed to be rearranged to the 180° domains due to the tensile effect from the glass film or coating present at the surface of the steel sheet and to finally contribute to refinement of the 180° domains.

When the deviation angle γ spreads to a certain extent, the core loss is reduced because, when the deviation angle γ is large, the energy balance of the above three axes of easy magnetization changes, rather than the <001> axis parallel to the rolling axis, one of the two <001> axes present in the direction forming an angle of 45° with the inner surface in the traverse direction is excited in increasing cases, and, as a result, the 180° domains are refined.

Further, the axial deviation indicator $(\alpha^2+\beta^2)^{1/2}$ is an indicator prescribing the excitation characteristic of the axis of easy magnetization parallel to the rolling axis, while the deviation angle γ is an indicator prescribing the excitation characteristic of the two <001> axes present in the direction forming an angle of 45° with the inner surface in the traverse direction. Therefore, which axis among the three axes of easy magnetization is excited is based on the correlative relationship of the above two indicators. The critical value of the deviation angle γ required for forming closure domains is not an absolute value, but may be considered to be determined by the correlative relationship with $(\alpha^2+\beta^2)^{1/2}$.

The inventors investigated the relationship between the γ (°) and axial deviation indicator $(\alpha^2+\beta^2)^{1/2}$ (°) so as to confirm this idea and evaluate the critical value of the deviation angle γ.

Figure 8:
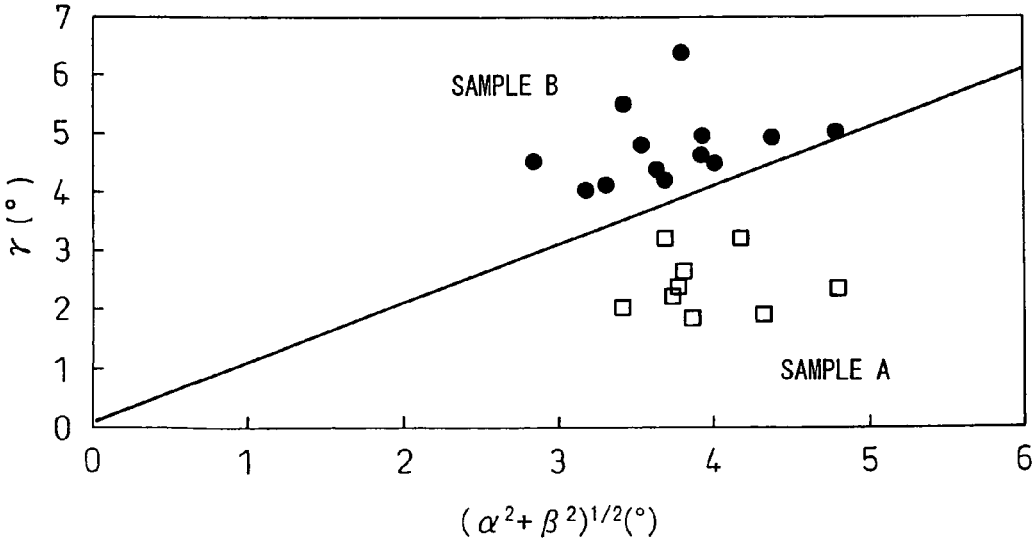
FIG. 8 shows the relationship between γ (°) and $(\alpha^2+\beta^2)^{1/2}$ (°) in the grain-oriented electrical steel sheet prepared by the method of production based on U.S. Pat. No. 3,287,183 and the grain-oriented electrical steel sheet prepared by the method of production based on Japanese Patent Publication (A) No. 2002-60842.

FIG. 8 shows the relationship between the deviation angle γ (°) and the axial deviation indicator $(\alpha^2+\beta^2)^{1/2}$ (°). In FIG. 8, it will be understood that the group of white squares (sample A) and the group of black dots (sample B) are separated by $\gamma=(\alpha^2+\beta^2)^{1/2}$.

That is, the sample B (group of black dots) is superior in core loss characteristic to the sample A (group of white squares) (see FIG. 4), so it is learned that the alignment of the {110}<001> secondary recrystallized texture of the grain-oriented electrical steel sheet superior in core loss characteristic must satisfy the relation $$(\alpha^2+\beta^2)^{1/2} \leqq \gamma$$

This result provides backing to the above postulation that "rather than the <001> axis parallel to the rolling axis, one of the two <001> axes present in the direction forming an angle of 45° with the inner surface in the traverse direction is excited to form the closure domains due to the correlative relationship of these domains, so the critical value of the deviation angle γ required for forming closure domains is not an absolute value, but is determined by the correlative relationship with $(\alpha^2+\beta^2)^{1/2}$."

Summarizing the above results, to secure a good core loss characteristic, the deviation angles α and β are preferably as small as possible and the deviation angle γ is at least the $(\alpha^2+\beta^2)^{1/2}$ (°) determined by the deviation angles α and β.

This point is a discovery (discovery Z) found by the inventors predicated on the discovery Y and, along with the discovery Y, is a discovery forming the basis of the present invention.

Therefore, the present invention provides a grain-oriented electrical steel sheet having a secondary recrystallized texture with a {110}<001> orientation as the main orientation characterized in that the average deviation angles α, β, and γ from the {110}<001> ideal orientation of the secondary recrystallized texture satisfy the following formula (1):

$$(\alpha^2+\beta^2)^{1/2} \leqq \gamma \quad (1)$$

To secure a good core loss characteristic, the average deviation angle γ must exceed $(\alpha^2+\beta^2)^{1/2}$. Further, the area percent of the crystal grains with average deviation angles γ exceeding $(\alpha^2+\beta^2)^{1/2}$ is preferably 40% or more.

Further, the core loss characteristic is more preferable the smaller the deviation angles α and β. According to FIG. 4, to secure a 0.85 W/kg or less core loss W17/50, the axial deviation indicator $(\alpha^2+\beta^2)^{1/2}$ preferably satisfy the following formula (2):

$$(\alpha_2+\beta^2)^{1/2} \leqq 4.4° \quad (2)$$

Further, to secure a 0.80 W/kg or less core loss W17/50, the axial deviation indicator $(\alpha^2+\beta^2)^{1/2}$ preferably satisfies the following formula (3):

$$(\alpha^2+\beta^2)^{1/2} \leqq 3.6° \quad (3)$$

Grain-oriented electrical steel sheet usually contains, by mass %, Si: 0.8 to 7%, so the grain-oriented electrical steel sheet of the present invention also contains Si: 0.8 to 7%, but may also contain, in addition to Si, at least one element of Mn: 1% or less, Cr: 0.3% or less, Cu: 0.4% or less, P: 0.5% or less, N: 1% or less, Mo: 0.1% or less, Sn: 0.3% or less, and Sb: 0.3% or less. Note that below, the "%" means mass %.

Mn is an element effective for raising the specific resistance and reducing the core loss. Further, Mn is an element effective for preventing cracking in hot rolling in the production process, but if the amount of addition exceeds 1%, the magnetic flux density of the product ends up falling, so the upper limit is made 1%.

Cr is also an element effective for raising the specific resistance and reducing the core loss. Further, Cr is an element improving the surface oxide layer after decarburizing annealing and is added in a range up to 0.3%.

Cu is also an element effective for raising the specific resistance and reducing the core loss but if the amount of addition exceeds 0.4%, the effect of reduction of the core loss ends up becoming saturated and, in the production process, the Cu becomes a cause of "bald spot" surface flaws at the time of hot rolling, so the upper limit is made 0.4%.

P is also an element effective for raising the specific resistance and reducing the core loss, but if the amount of addition exceeds 0.5%, a problem will arise in the rollability of the steel sheet, so the upper limit is made 0.5%.

Ni is also an element effective for raising the specific resistance and reducing the core loss. Further, Ni is an element effective in controlling the metal structure of hot rolled sheet to improve the magnetic properties, but if the amount of addition exceeds 1%, the secondary recrystallization becomes unstable, so the upper limit is made 1%.

Mo is also an element effective for raising the specific resistance and reducing the core loss. but if the amount of addition exceeds 0.1%, a problem will arise in the rollability of the steel sheet, so the upper limit is made 0.1%.

Sn and Sb are elements effective for stabilizing the secondary recrystallization and developing the {110}<001> orientation, but if over 0.3%, have a detrimental effect on the formation of the glass film, so the upper limit is made 0.3%.

Regarding C, N, S, Ti, and Al, these are sometimes added in the steelmaking stage for controlling the texture and controlling the inhibitor to stably realize secondary recrystallization, but they are also elements degrading the core loss characteristic of the final products, so have to be reduced after decarburizing annealing and in final annealing etc. For this reason, the content of these elements is made not more than 0.005%, preferably not more than 0.003%.

Further, the grain-oriented electrical steel sheet of the present invention may contain elements other than the above and/or unavoidable impurity elements to an extent not impairing the magnetic properties.

For the method of production of grain-oriented electrical steel sheet of the present invention, basically the method of production based on Japanese Patent Publication (A) No. 2002-60842 etc. may be used. To make the deviation angles α, β, and γ reliably satisfy the above formula (1), in the primary recrystallized texture, the ratio of the {411} oriented grains in the {411} oriented grains and {111} oriented grains promoting the growth of the Goss oriented secondary recrystallized grains has to be raised. As the method for raising the ratio of the {411} oriented grains, the technique of controlling the heating rate of the decarburizing annealing described in Japanese Patent Publication (A) No. 2002-60842 is effective.

EXAMPLES

Next, examples of the present invention will be explained, but the conditions of the examples are examples of conditions employed for confirming the workability and advantageous effects of the present invention. The present invention is not limited to these examples of conditions. The present invention can employ various conditions so long as not out of the gist of the present invention and achieving the object of the present invention.

Example 1

As the sample (A), a slab containing, by mass %, Si: 3.2%, C: 0.08%, acid soluble Al: 0.024%, N: 0.007%, Mn: 0.08%, and S: 0.025% was heated at a temperature of 1350° C., was hot rolled to 2.3 mm thickness, then was cold rolled to 1.8 mm thickness, then was annealed and, further, was cold rolled to 0.23 mm thickness.

After this, the sheet was heated to a temperature of 850° C. and decarburizing annealed, then was coated with an annealing separator mainly comprised of MgO, then was final annealed.

As the sample (B), a slab containing, by mass %, Si: 3.3%, C: 0.06%, acid soluble Al: 0.027%, N: 0.007%, Mn: 0.1%, and S: 0.07% was heated at a temperature of 1150° C., then was hot rolled to 2.3 mm thickness and annealed, then was cold rolled to 0.23 mm thickness.

After this, the sheet was heated to a temperature of 830° C. and decarburizing annealed, then was annealed in an ammonia-containing atmosphere to increase the N in the steel sheet to 0.02%, then was coated with an annealing separator mainly comprised of MgO, then was final annealed.

The C, N, S, and Al after the final annealing were all reduced to 0.003% or less. After that, the sheet was coated to provide insulating ability and tensile strength.

The results of measurement of the secondary recrystallization orientation alignment and magnetic properties of the product are shown in Table 1. For the magnetic flux density $B_8$, to clarify the relationship with the secondary recrystallization orientation of steel sheet, the nonmagnetic materials on the product surface (glass film and coating) were removed before measurement.

Further, the area percentages of crystal grains satisfying $(\alpha^2+\beta^2)^{1/2} \leqq \gamma$ were, for the sample (A) and sample (B), respectively 18% and 47%.

TABLE 1

| Sample | $(\alpha^2+\beta^2)^{1/2}$ (°) | γ (°) | Core loss W17/50 (W/kg) | Magnetic flux density $B_8$ (T) | Remarks |
|---|---|---|---|---|---|
| (A) | 3.7 | 2.1 | 0.84 | 1.939 | Comp. ex. |
| (B) | 3.2 | 5.3 | 0.78 | 1.947 | Inv. ex. |

Example 2

As the sample, a slab containing, by mass %, Si: 3.3%, C: 0.06%, acid soluble Al: 0.028%, and N: 0.008% was heated at a temperature of 1150° C., then was hot rolled to 2.3 mm thickness, was annealed, then was cold rolled to 0.23 mm thickness.

After this, it was heated by a heating rate of (A) 5°/s, (B) 100°/s, or (C) 200°/s to a temperature of 830° C. and decarburizing annealed, then was annealed in an ammonia-containing atmosphere to increase the N in the steel sheet to 0.02%, then was coated with an annealing separator mainly comprised of MgO, then was final annealed.

The C, N, and Al after the final annealing were all reduced to 0.003% or less. After that, the sheet was coated to provide insulating ability and tensile strength.

The results of measurement of the secondary recrystallization orientation alignment and magnetic properties of the product are shown in Table 2. For the magnetic flux density $B_8$, to clarify the relationship with the secondary recrystallization orientation of steel sheet, the nonmagnetic materials on the product surface (glass film and coating) were removed before measurement.

TABLE 2

| | $(\alpha^2+\beta^2)^{1/2}$ (°) | γ (°) | Core loss W17/50 (W/kg) | Magnetic flux density $B_8$ (T) | Remarks |
|---|---|---|---|---|---|
| (A) | 4.9 | 2.5 | 0.93 | 1.901 | Comp. ex. |
| (B) | 3.2 | 5.3 | 0.78 | 1.947 | Inv. ex. |
| (C) | 3.8 | 5.6 | 0.81 | 1.941 | Inv. ex. |

Example 3

As the sample, a slab containing, by mass %, Si: 3.3%, C: 0.055%, acid soluble Al: 0.027%, and N: 0.008% was heated at a temperature of 1150° C., then was hot rolled to 2.3 mm thickness, was annealed, then was cold rolled to 0.23 mm thickness.

After this, it was heated by a heating rate of 40°/s to (A) 790° C., (B) 820° C., or (C) 850° and decarburizing annealed, then was annealed in an ammonia-containing atmosphere to increase the N in the steel sheet to 0.02%, then was coated with an annealing separator mainly comprised of MgO, then was final annealed.

The C, N, and Al after the final annealing were all reduced to 0.003% or less. After that, the sheet was coated to provide insulating ability and tensile strength.

The results of measurement of the secondary recrystallization orientation alignment and magnetic properties of the product are shown in Table 3. For the magnetic flux density $B_8$, to clarify the relationship with the secondary recrystallization orientation of steel sheet, the nonmagnetic materials on the product surface (glass film and coating) were removed before measurement.

Further, the area percentages of crystal grains satisfying $(\alpha^2+\beta^2)^{1/2} \leqq \gamma$ were, for the sample (A), sample (B), and sample (C), respectively 24%, 38%, and 49%.

TABLE 3

| Sample | $(\alpha^2+\beta^2)^{1/2}$ (°) | γ (°) | Core loss W17/50 (W/kg) | Magnetic flux density $B_8$ (T) | Remarks |
|---|---|---|---|---|---|
| (A) | 5.3 | 3.5 | 0.95 | 1.903 | Comp. ex. |
| (B) | 4.6 | 5.0 | 0.84 | 1.918 | Inv. ex. |
| (C) | 3.5 | 5.1 | 0.79 | 1.938 | Inv. ex. |

INDUSTRIAL APPLICABILITY

As explained above, according to the present invention, by controlling the secondary recrystallization orientation distribution, it is possible to provide grain-oriented electrical steel sheet having a superior core loss characteristic over the conventional limit. Accordingly, the present invention has a high applicability in industries producing electrical equipment using grain-oriented electrical steel sheet as materials.

The invention claimed is:

1. Grain-oriented electrical steel sheet superior in core loss characteristic containing Si: 0.8 to 7 mass %, and not more than 0.005 mass % in total of C, N, S, Ti and Al, and having a secondary recrystallized texture with a {110}<001> orientation as the main orientation, said grain-oriented electrical steel sheet characterized in that average deviation angles α, β, and γ from the {110}<001> ideal orientation of the secondary recrystallized texture satisfy the following formula (1):

$$(\alpha^2+\beta^2)^{1/2} \leqq \gamma \quad (1)$$

where,

α: average deviation angle from {110}<001> ideal orientation around rolling surface normal direction (ND) of secondary recrystallized texture, β: average deviation angle from {110}<001> ideal orientation around traverse direction (TD) of secondary recrystallized texture, and γ: average deviation angle from {110}<001> ideal orientation around rolling direction (RD) of secondary recrystallized texture.

2. Grain-oriented electrical steel sheet superior in core loss characteristic containing Si: 0.8 to 7 mass %, and not more than 0.005 mass % in total of C, N, S, Ti and Al, and having a secondary recrystallized texture with a {110}<001> orientation as the main orientation, said grain-oriented electrical steel sheet characterized in that average deviation angles α, β, and γ from the {110}<001> ideal orientation of the secondary recrystallized texture satisfy the following formulas (1) and (2):

$$(\alpha^2+\beta^2)^{1/2} \leqq \gamma \quad (1)$$

$$(\alpha^2+\beta^2)^{1/2} \leqq 4.4^\circ \quad (2)$$

where,

α: average deviation angle from {110}<001> ideal orientation around rolling surface normal direction (ND) of secondary recrystallized texture, β: average deviation angle from {110}<001> ideal orientation around traverse direction (TD) of secondary recrystallized texture, and γ: average deviation angle from {110}<001> ideal orientation around rolling direction (RD) of secondary recrystallized texture.

3. Grain-oriented electrical steel sheet superior in core loss characteristic containing Si: 0.8 to 7 mass %, and not more than 0.005 mass % in total of C, N, S, Ti and Al, and having a secondary recrystallized texture with a {110}<001> orientation as the main orientation, said grain-oriented electrical steel sheet characterized in that average deviation angles α, β, and γ from the {110}<001> ideal orientation of the secondary recrystallized texture satisfy the following formulas (1) and (3):

$$(\alpha^2+\beta^2)^{1/2} \leqq \gamma \quad (1)$$

$$(\alpha^2+\beta^2)^{1/2} \leqq 3.6^\circ \quad (3)$$

where,

α: average deviation angle from {110}<001> ideal orientation around rolling surface normal direction (ND) of secondary recrystallized texture, β: average deviation angle from {110}<001> ideal orientation around traverse direction (TD) of secondary recrystallized texture, and γ: average deviation angle from {110}<001> ideal orientation around rolling direction (RD) of secondary recrystallized texture.

4. Grain-oriented electrical steel sheet superior in core loss characteristic as set forth in claim 1, 2 or 3, characterized in that an area of crystal grains satisfying the formula (1) is 40% or more.

5. Grain-oriented electrical steel sheet superior in core loss characteristic as set forth in claim 1, 2 or 3, characterized in that said grain-oriented electrical steel sheet further contains, by mass %, at least one of Mn: 1% or less, Cr: 0.3% or less, Cu: 0.4% or less, P: 0.5% or less, Ni: 1% or less, Mo: 0.1% or less, Sn: 0.3% or less, and Sb: 0.3% or less.

6. Grain-oriented electrical steel sheet superior in core loss characteristic as set forth in claim 1, 2 or 3 characterized in that said grain-oriented electrical steel sheet contains, not more than 0.003 mass % in total of C, N, S, Ti and Al.

* * * * *